US012692760B2

(12) United States Patent
Hern et al.

(10) Patent No.: US 12,692,760 B2
(45) Date of Patent: Jul. 28, 2026

(54) ANNULAR PRESSURE ACTIVATED DOWNHOLE TOOL

(71) Applicant: Baker Hughes Oilfield Operations LLC, Houston, TX (US)

(72) Inventors: Gregory L. Hern, Porter, TX (US); Tuan Nguyen, Pearland, TX (US); Philip M. Gregurek, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/624,635

(22) Filed: Apr. 2, 2024

(65) Prior Publication Data

US 2024/0247558 A1 Jul. 25, 2024

Related U.S. Application Data

(60) Division of application No. 18/592,880, filed on Mar. 1, 2024, which is a continuation of application No. (Continued)

(51) Int. Cl.
*E21B 23/04* (2006.01)
*E21B 7/06* (2006.01)
(Continued)

(52) U.S. Cl.
CPC ..... *E21B 23/042* (2020.05); *E21B 7/061* (2013.01); *E21B 23/04* (2013.01); *E21B 23/0411* (2020.05); *E21B 23/04115* (2020.05); *E21B 23/06* (2013.01); *E21B 29/06* (2013.01); *E21B 33/129* (2013.01)

(58) Field of Classification Search
CPC ..... E21B 23/04; E21B 23/042; E21B 23/06; E21B 23/0411; E21B 23/04115
See application file for complete search history.

(56) References Cited

U.S. PATENT DOCUMENTS 5,878,818 A 3/1999 Hebert et al.
11,136,843 B1 10/2021 Nguyen et al.
(Continued)

OTHER PUBLICATIONS

International Search Report and Written Opinion; PCT/US2023/011969; Korean Intellectual Property Office; Mailed May 25, 2023; 8 pages.

*Primary Examiner* — Tara Schimpf
*Assistant Examiner* — Lamia Quaim
(74) *Attorney, Agent, or Firm* — Baker Hughes Company

(57) ABSTRACT

An annular pressure activated downhole tool has a housing including an outer surface, an inner surface defining a passage, an annular projection projecting into the passage from the inner surface, and an opening. A mandrel extends into the passage. The mandrel has a first end and a second end. A power spring support is detachably connected to the second end of the mandrel in the passage. A power spring is arranged about the mandrel and extends between the power spring support and the annular projection. A trigger housing is arranged in one of the mandrel and the power spring support. A trigger arranged in the trigger housing selectively engages with the inner surface. The trigger is operable to disengage from the inner surface of the housing, releasing the power spring, and shifting the mandrel along the passage when exposed to a selected annular pressure.

8 Claims, 7 Drawing Sheets

Related U.S. Application Data

17/591,881, filed on Feb. 3, 2022, now Pat. No. 12,044,086.

(51) Int. Cl.

| | |
|---|---|
| ***E21B 23/06*** | (2006.01) |
| ***E21B 29/06*** | (2006.01) |
| ***E21B 33/129*** | (2006.01) |

(56) References Cited

U.S. PATENT DOCUMENTS

| | | | | |
|---|---|---|---|---|
| 11,162,315 | B2 | 11/2021 | Harrington et al. | |
| 11,414,943 | B2 | 8/2022 | Nguyen et al. | |
| 11,578,551 | B2 | 2/2023 | Yakeley | |
| 2002/0148617 | A1* | 10/2002 | Dewey | E21B 33/12 166/117.6 |
| 2009/0294137 | A1* | 12/2009 | Meijer | E21B 33/1295 166/120 |
| 2013/0341048 | A1 | 12/2013 | Delgado et al. | |
| 2019/0292862 | A1* | 9/2019 | O'Brien | E21B 34/063 |
| 2021/0301609 | A1 | 9/2021 | Nguyen et al. | |
| 2021/0301610 | A1 | 9/2021 | Nguyen et al. | |
| 2021/0301614 | A1 | 9/2021 | Nguyen et al. | |
| 2021/0355775 | A1 | 11/2021 | Xu et al. | |
| 2023/0243221 | A1 | 8/2023 | Hern et al. | |
| 2024/0200416 | A1 | 6/2024 | Hern et al. | |

* cited by examiner

ANNULAR PRESSURE ACTIVATED DOWNHOLE TOOL

CROSS-REFERENCE TO RELATED APPLICATIONS

This application is a divisional of and claims priority to U.S. Continuation application Ser. No. 18/592,880, filed Mar. 1, 2024, which is a continuation of and claims priority to U.S. application Ser. No. 17/591,881, filed Feb. 3, 2022, the contents of which are hereby incorporated by reference in its entirety.

BACKGROUND

In the resource recovery industry tools are run into a wellbore for a variety of operations. Tools can include sliding sleeves, anchors, slips, packers, production equipment, window cutting systems and the like. Tools may be run-in in a first configuration and then shifted to a second configuration to support a downhole operation. In many cases, the tools are located downhole of a casing exist system. In such cases, activating the tools can present a challenge. Activation is typically conducted through the application of fluid pressure. Hydraulic lines are passed through the casing exit system to the tool(s).

In most cases, the casing exit system includes a whipstock that guides a drill bit laterally outwardly of a borehole. The whipstock includes a whipstock valve that connects hydraulic lines running uphole with hydraulic lines running downhole to the tool(s). Hydraulic lines can become damaged during run in, and whipstock valves can be damaged or clogged making setting the tool(s) difficult if not impossible. Accordingly, it would be desirable to provide a system for triggering a packer and/or anchor that does not rely on control lines passing through a drill bit and/or a whipstock connector.

SUMMARY

Disclosed, in accordance with a non-limiting example, is an annular pressure activated downhole tool having a housing including an outer surface, an inner surface defining a passage, an annular projection projecting into the passage from the inner surface, and an opening exposing the passage to annular pressure. A mandrel extends into the passage. The mandrel has a first end and a second end. A power spring support is detachably connected to the second end of the mandrel in the passage. A power spring is arranged about the mandrel and extends between the power spring support and the annular projection. A trigger housing is arranged in one of the mandrel and the power spring support, the trigger housing being selectively aligned with the opening in the housing exposing the passage to annular pressure. A trigger arranged in the trigger housing selectively engages with the inner surface. The trigger is operable to disengage from the inner surface of the housing, releasing the power spring, and shifting the mandrel along the passage when exposed to a selected annular pressure.

Also disclosed in accordance with a non-limiting example, is a resource exploration and recovery system including a surface system and a subsurface system including a tubular string. The tubular string includes a casing exit system and an annular pressure activated tool arranged downhole of the casing exist system. The annular pressure activated tool includes a housing including an outer surface, an inner surface defining a passage, an annular projection projecting into the passage from the inner surface, and an opening exposing the passage to annular pressure. A mandrel extends into the passage. The mandrel has a first end and a second end. A power spring support is detachably connected to the second end of the mandrel in the passage. A power spring is arranged about the mandrel and extends between the power spring support and the annular projection. A trigger housing is arranged in one of the mandrel and the power spring support, the trigger housing being selectively aligned with the opening in the housing exposing the passage to annular pressure. A trigger arranged in the trigger housing selectively engages with the inner surface. The trigger is operable to disengage from the inner surface of the housing, releasing the power spring, and shifting the mandrel along the passage when exposed to a selected annular pressure.

Further disclosed in accordance with a non-limiting example, is a method of activating a downhole tool includes introducing a tubular string supporting the downhole tool into a wellbore formed in a formation, adjusting pressure in an annulus defined about the downhole tool in the wellbore, activating a trigger at the downhole tool with the pressure in the annulus, releasing a spring upon activating the trigger, and applying a force to a mandrel in the tubular string to activate the downhole tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
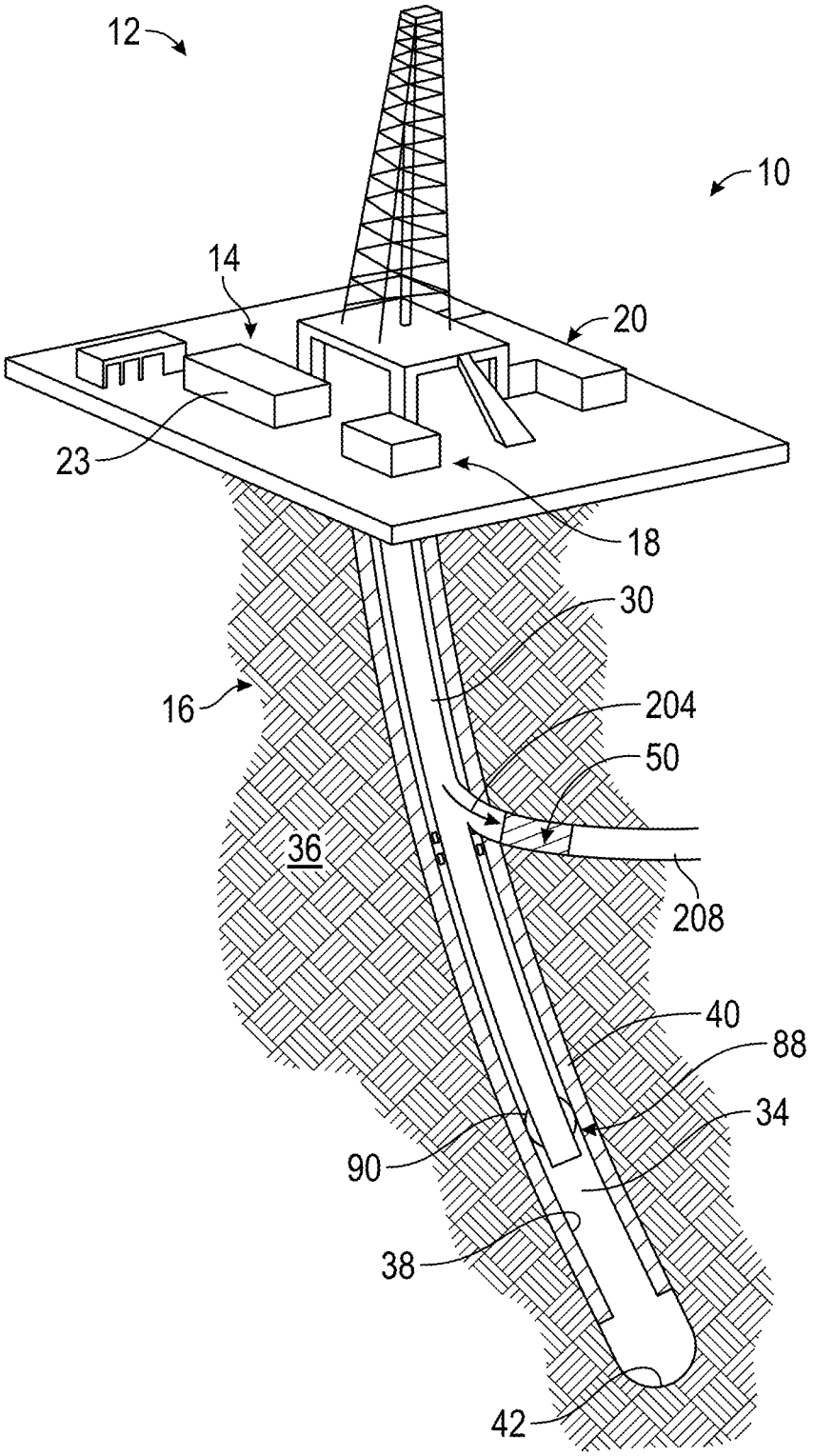
FIG. 1 depicts a resource exploration and recovery system including an annular pressure activated downhole tool, in accordance with a non-limiting example.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
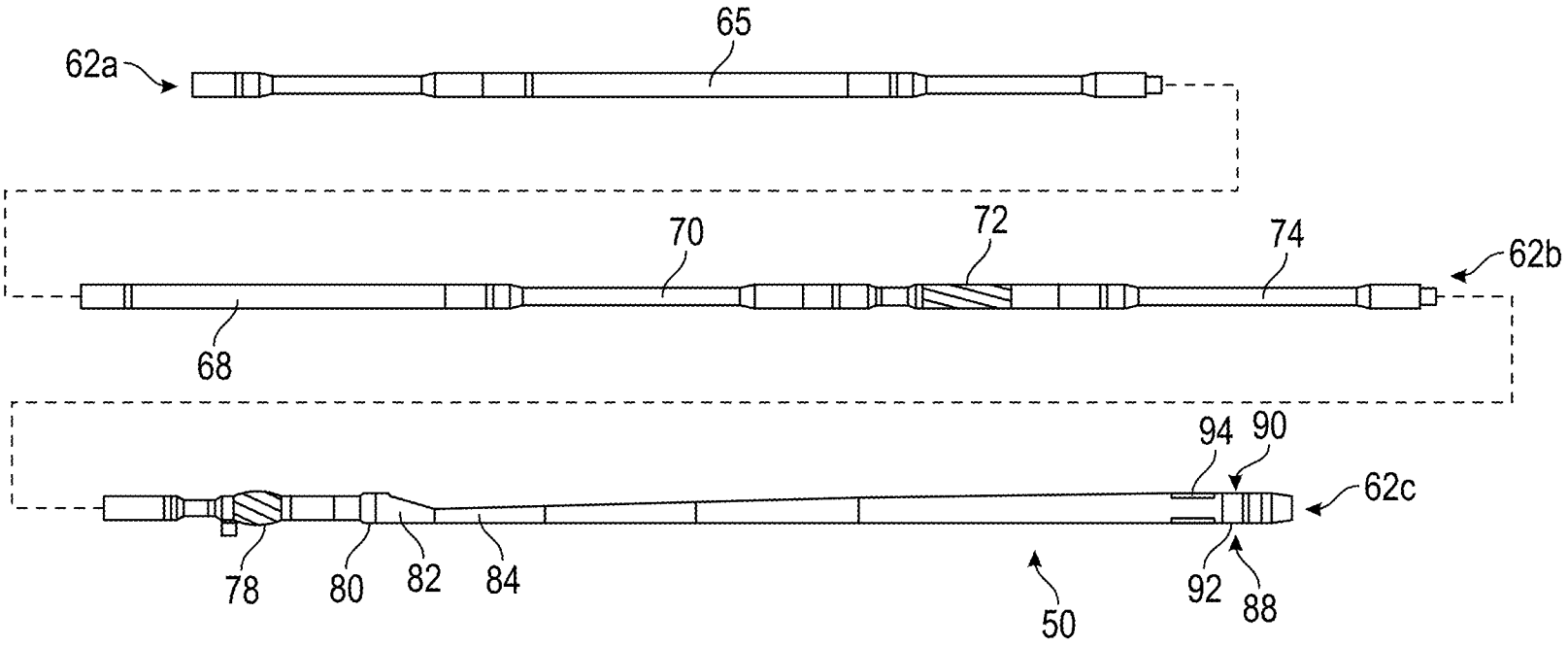
FIG. 2 depicts a work string including the annular pressure activated downhole tool of FIG. 1, in accordance with a non-limiting example.

In accordance with an exemplary aspect, tubular string 30 may support a casing exit or window cutting system 50. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. In a non-limiting example, each segment 62*a*. 62*b*, and 62*c* may be made up off-site and delivered to first system 12 for introduction into wellbore 34.

In a non-limiting example, first segment 62*a* may support a measurement while drilling (MWD) system 65 that includes various instrumentation systems which monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and annular pressure activated tool 88 that may include an anchor 90 with slips 92 and an expandable packer 94.

Figure 3:
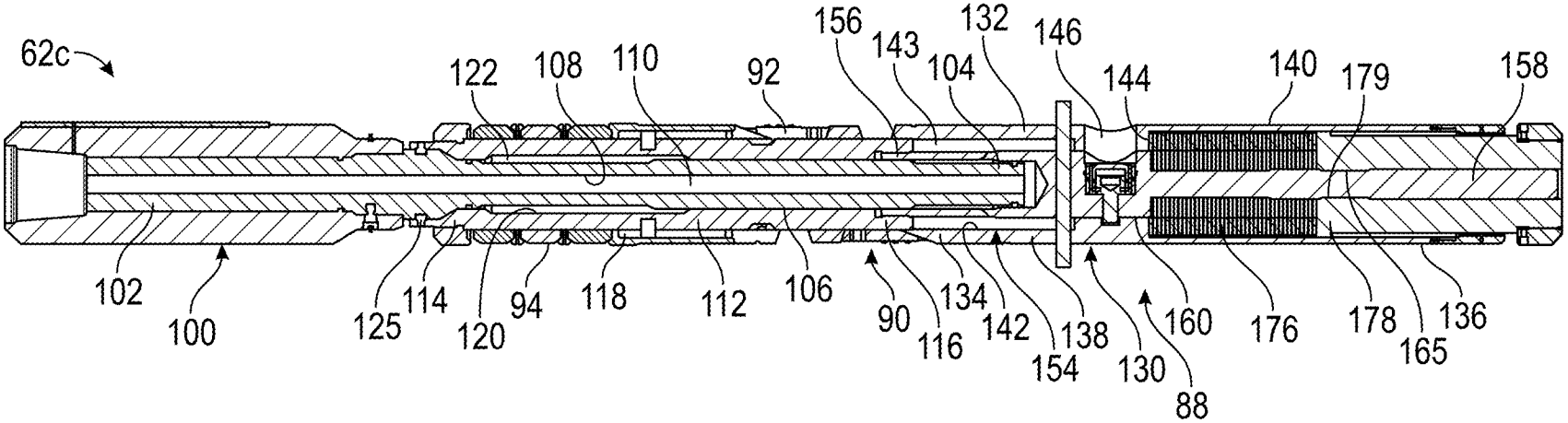
FIG. 3 is a cross-sectional side view of the annular pressure activated downhole tool in a pre-run-in configuration, in accordance with an exemplary embodiment.
Figure 4:
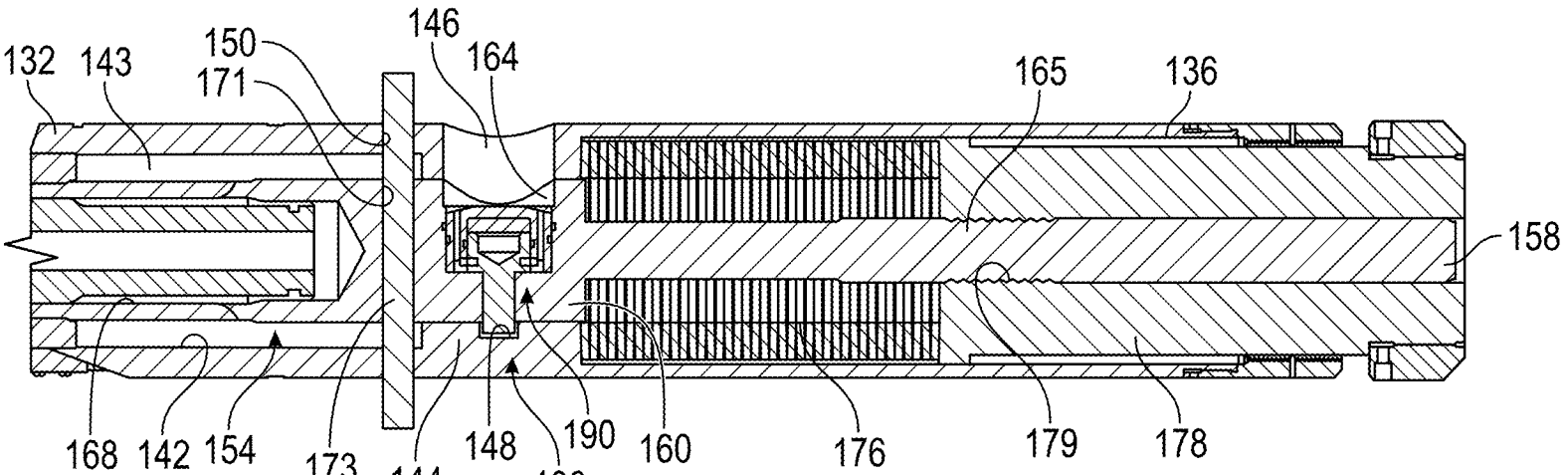
FIG. 4 is a cross-sectional side view of an annular pressure activated trigger portion of the annular pressure activated downhole tool of FIG. 3, in accordance with a non-limiting example.

Referring to FIGS. 3 and 4, third tubular segment 62*c* includes a tubular 100 that supports annular pressure activated tool 88 in accordance with a non-limiting example. Tubular 100 includes a first end section 102 and a second end section 104. An outer surface section 106 and an inner surface section 108 extend between first end section 102 and second end section 104. Inner surface section 108 defines a passage section 110 that extends entirely through tubular 100. In a non-limiting example, a tool support 112 is supported on tubular 100.

In a non-limiting example, tool support 112 includes a first end portion 114 and a second end portion 116. An outer surface portion 118 and an inner surface portion 120 extend between first end portion 114 and second end portion 116. Inner surface portion 120 defines a passage portion 122 receptive of tubular 100. Tool support 112 is secured to outer surface section 106 of tubular 100 by a frangible connector 125.

In a non-limiting example, an annular pressure activation system 130 is connected with tubular 100 and tool support 112. Annular pressure activation system 130 includes a housing 132 having a first end segment 134, a second end segment 136, and an intermediate segment 138. An outer surface 140 and an inner surface 142 extend between first end segment 134 and second end segment 136. Inner surface 142 defines a passage 143 having an annular projection 144. An opening 146 extends from outer surface 140 through annular projection 144. Annular projection 144 includes a recess 148 opposite to opening 146. In a non-limiting example, a lock receiving passage 150 is axially spaced from opening 146 in an uphole direction.

In a non-limiting example, a mandrel 154 extends through passage 143 and connects with tubular 100. Mandrel 154 includes a first end 156, a second end 158, and an intermediate portion 160. A trigger housing 164 (FIG. 4) extends radially into intermediate portion 160. Trigger housing 164 selectively aligns with opening 146 as will become more fully evident herein. Mandrel 154 includes a threaded section 165 that is axially spaced from second end 158. A chamber 168 extends into first end 156. Chamber 168 is receptive of second end section 104 of tubular 100.

Figure 5:
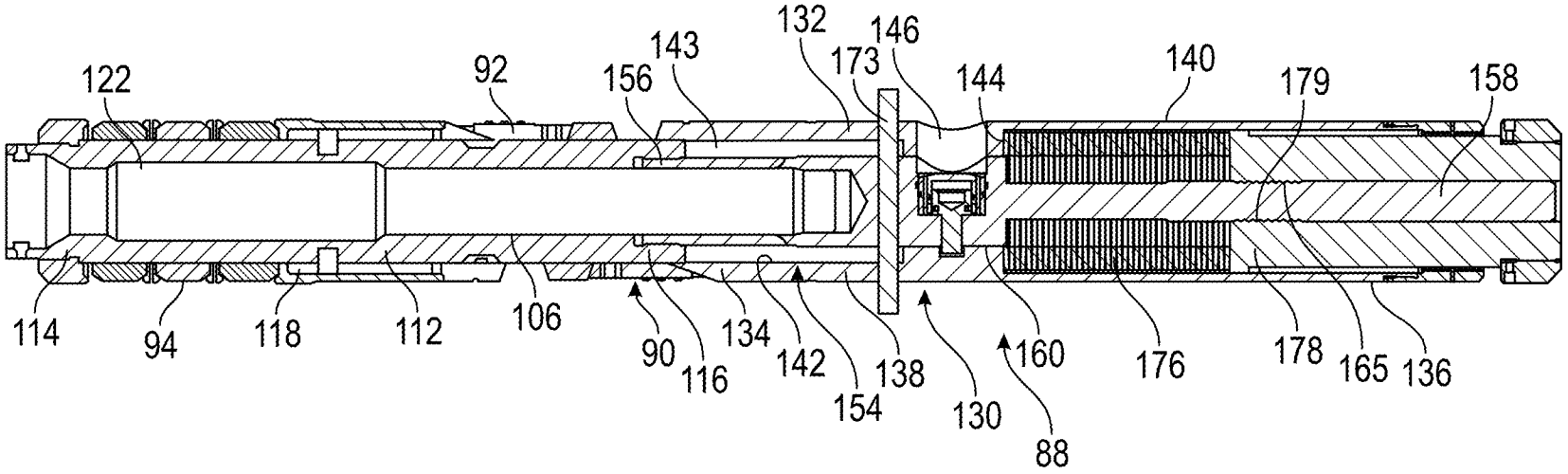
FIG. 5 is a cross-sectional side view of the annular pressure activated downhole tool of FIG. 3 in a run-in configuration, in accordance with a non-limiting example.

In a non-limiting example, a passage 171 extends through intermediate portion 160 between trigger housing 164 and chamber 168. Passage 171 is receptive of a lock member 173. That is, lock member 173 extends through housing 132 and mandrel 154. Lock member 173 maintains a selected alignment between opening 146 and trigger housing 164. Lock member 173 is passed through housing 162 and mandrel 154. A power spring 176 is positioned over second end 158. A power spring support 178 is connected to second end 158. Power spring support 178 includes a threaded portion 179 that engages with threaded section 165 to establish a pre-load on power spring 176. Once power spring 176 is compressed to a selected tension, a trigger 190 is inserted into trigger housing 164. Trigger 190 engages with recess 148 in housing 132. At this point, lock member 173 may be removed as shown in FIG. 5 in preparation for running tubular string 30 into wellbore 34. It should be understood that the above sequence is simply one non-limiting example for preparing annular pressure activated tool(s) 100. The sequence can of course be altered.

Figure 6:
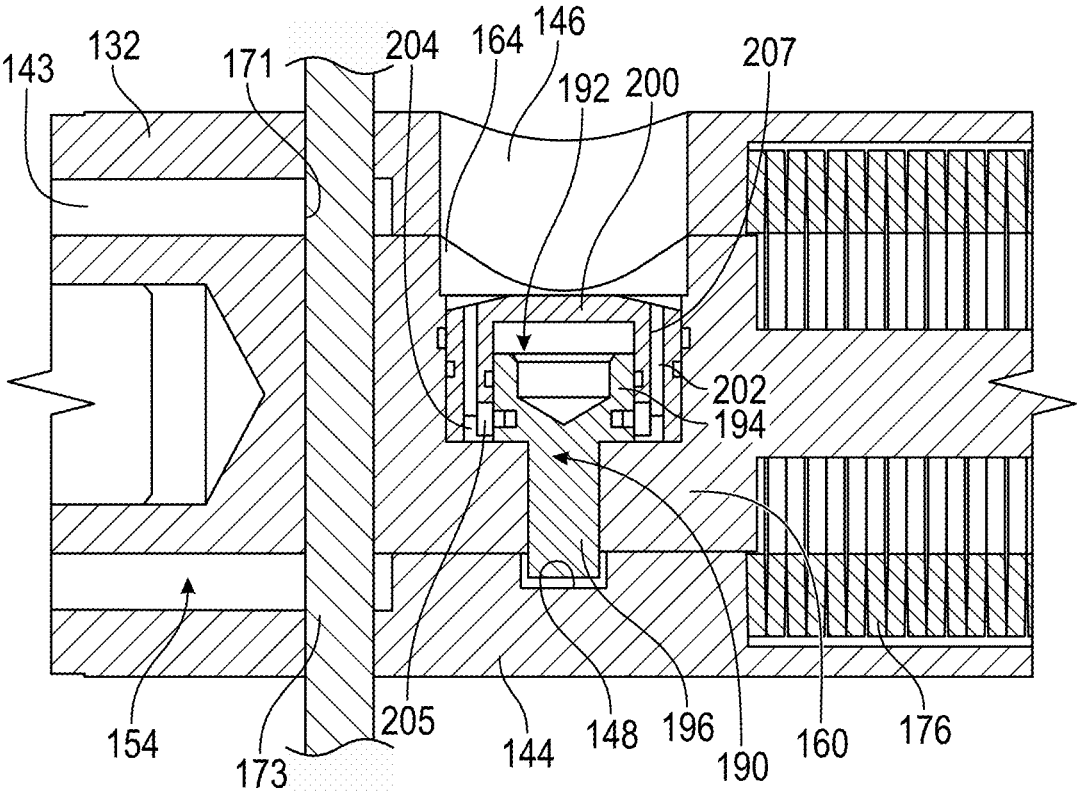
FIG. 6 depicts a cross-sectional side view of a trigger for the activation system, in accordance with a non-limiting example.

In a non-limiting example shown in FIG. 6, trigger 190 includes a piston 192 arranged in trigger housing 164. Piston 192 includes a first piston portion 194 having a first diameter and a second piston portion 196 having a second diameter. First piston portion 194 extends through mandrel 154 into recess 148 locking mandrel 154 to housing 132. In a non-limiting example, a cap 200 is arranged in trigger housing 164 covering piston 192. Cap 200 includes a passage 202 that extends to a chamber 204 defined adjacent an interface (not separately labeled) between first piston portion 194 and second piston portion 196 in trigger housing 164. Piston 192 is secured in and to cap 200 by one or more shear elements 205. A burst disc 207 may be arranged in passage 202. If provided, burst disc 207 selectively isolates chamber 204 from annular pressure.

Figure 7:
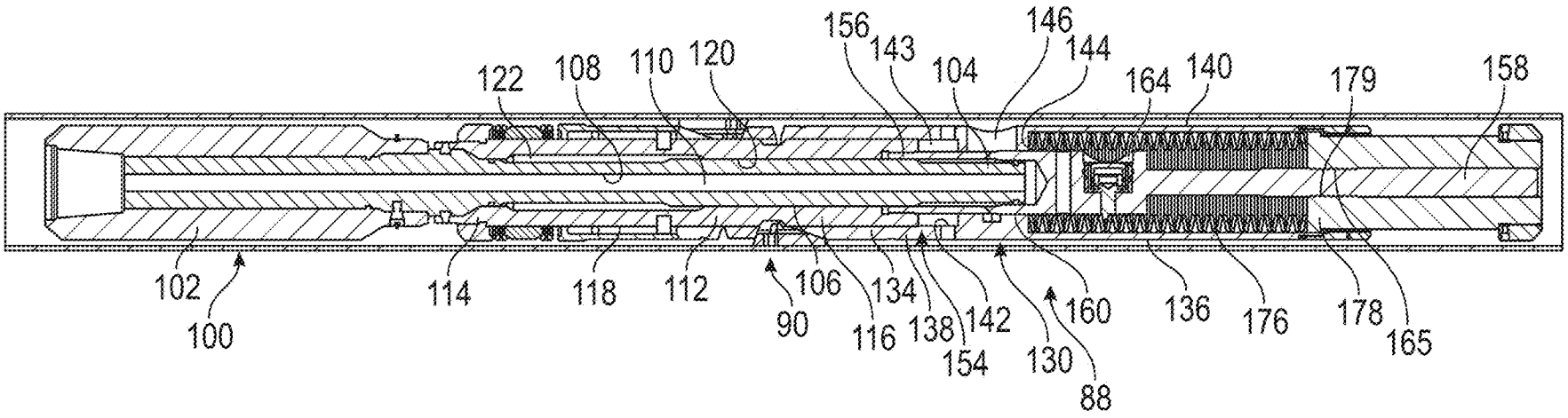
FIG. 7 is a cross-sectional side view of the annular pressure activated downhole tool of FIG. 3 in a deployed configuration, in accordance with a non-limiting example.
Figure 8:
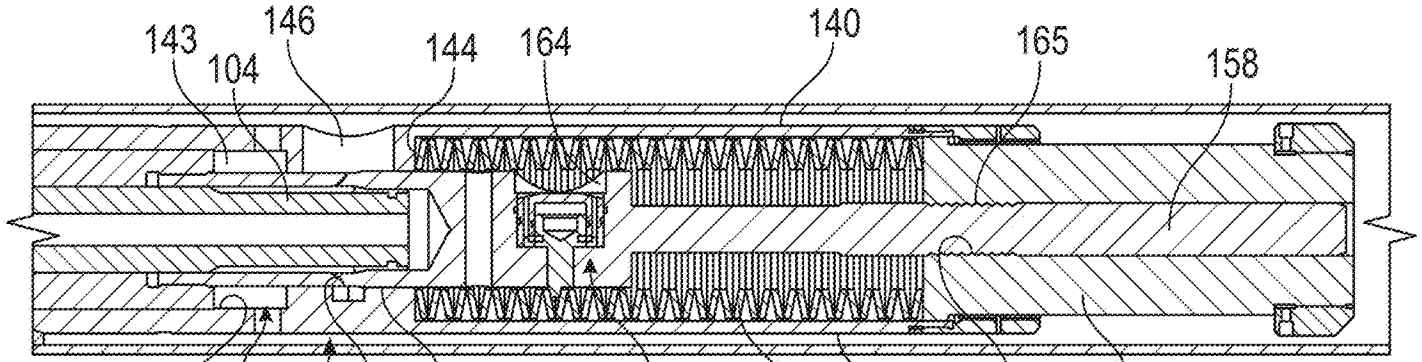
FIG. 8 is a cross-sectional side view of the pressure activated trigger portion of the annular pressure activated downhole tool of FIG. 5, in accordance with a non-limiting example.

In a non-limiting example, fluid pressure may be raised in wellbore 34 causing pressure in passage 202 to increase. If provided, when a selected pressure is reached, burst disc 207 to fracture. If no burst disc is provided, pressure may simply increase Fluid may pass through passage 202 and flow into chamber 204. Pressure in chamber 204 acts against piston 192 causing shear element 205 to fail. At this point, piston 192 may move radially outwardly such that second piston portion 195 disengages from recess 148 as shown in FIGS. 7 and 8. At this point, mandrel 154 is no longer restrained and power spring 175 acts to shift housing 132 in an uphole direction to set anchor 90 and/or expandable packer 94. By using annular pressure to set tools below whipstock connector 84, there is no longer a need for complicated plumbing, or wiring to pass through window mill 80.

Figure 9:
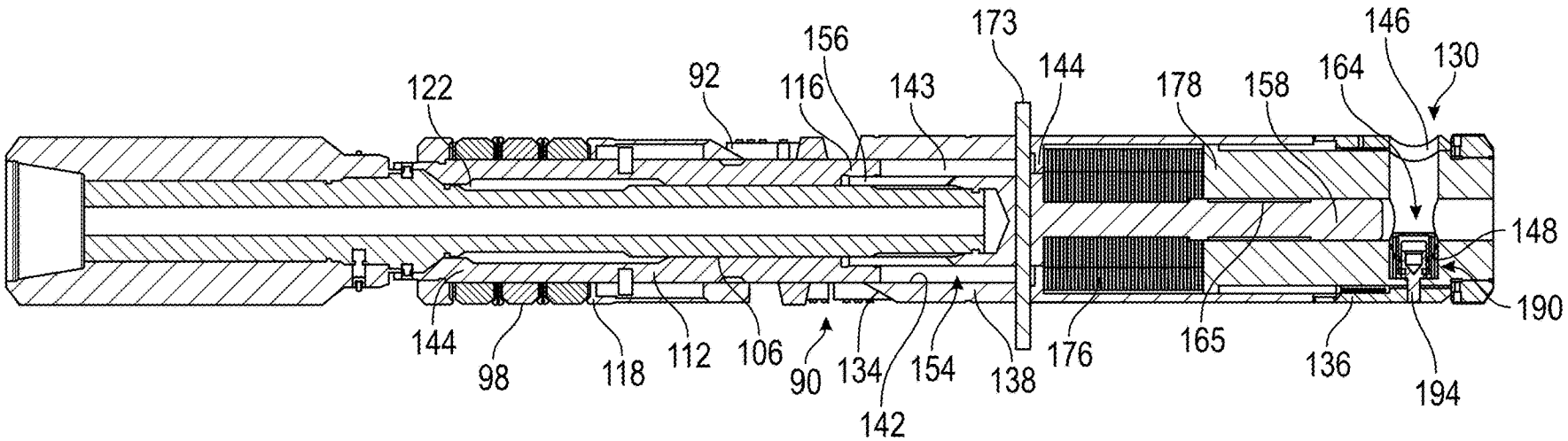
FIG. 9 is a cross-sectional side view of the annular pressure activated downhole tool of FIG. 3 in a run-in configuration, in accordance with another non-limiting example.

In accordance with another non-limiting example, instead of being arranged in mandrel 154, trigger housing 164 could be formed in power spring support 178 as shown in FIG. 9.

Regardless of the location of trigger housing 164, after setting anchor 90 and/or expandable packer 94, casing exit system 50 may be activated to form a window 204 (FIG. 1) in casing 40. After forming window 204, casing exit system 50 may continue into formation 36 to form a wellbore lateral 208. Wellbore lateral 208 extends into formation 36 at an angle relative to wellbore 34. At this point, hydrocarbons can be produced from wellbore 34 and/or wellbore lateral 208.

Set Forth Below are Some Embodiments of the Foregoing Disclosure:

Embodiment 1. An annular pressure activated downhole tool comprising: a housing including an outer surface, an inner surface defining a passage, an annular projection projecting into the passage from the inner surface, and an opening exposing the passage to annular pressure; a mandrel extending into the passage, the mandrel having a first end and a second end; a power spring support detachably connected to the second end of the mandrel in the passage; a power spring arranged about the mandrel and extending between the power spring support and the annular projection; a trigger housing is formed in one of the mandrel and the power spring support, the trigger housing being selectively aligned with the opening in the housing exposing the passage to annular pressure, and a trigger arranged in the trigger housing selectively engaged with the inner surface, the trigger being operable to disengage from the inner surface of the housing, releasing the power spring, and shifting the mandrel along the passage when exposed to a selected annular pressure.

Embodiment 2. The annular pressure activated tool according to any prior embodiment, further comprising: a tool support including an outer surface portion, an inner surface portion defining a passage portion, a first end portion, and a second end portion, the second end portion extending into the passage and about the mandrel.

Embodiment 3. The annular pressure activated tool according to any prior embodiment, further comprising: one of a slip and an expandable packer mounted to the outer surface portion.

Embodiment 4. The annular pressure activated tool according to any prior embodiment, further comprising: a tubular extending through the passage portion, the tubular including a first end section and a second end section connected to the mandrel.

Embodiment 5. The annular pressure activated tool according to any prior embodiment, wherein the first end section of the tubular is mechanically connected with the first end portion of the tool support.

Embodiment 6. The annular pressure activated tool according to any prior embodiment, further comprising: a frangible connector mechanically connecting the tubular and the first end portion of the tool support.

Embodiment 7. The annular pressure activated downhole tool according to any prior embodiment, wherein the trigger comprises a piston arranged in the trigger housing.

Embodiment 8. The annular pressure activated downhole tool according to any prior embodiment, further comprising: a shear element affixing the piston in the trigger housing.

Embodiment 9. The annular pressure activated downhole tool according to any prior embodiment, further comprising: a cap provided at the trigger and a passage extending though the cap fluidically connecting the trigger and the wellbore annulus.

Embodiment 10. The annular pressure activated downhole tool according to any prior embodiment, wherein the trigger housing is formed in the mandrel.

Embodiment 11. A resource exploration and recovery system comprising: a surface system; a subsurface system including a tubular string, the tubular string including a casing exit system and an annular pressure activated tool arranged downhole of the casing exist system, the annular pressure activated tool comprising: a housing including an outer surface, an inner surface defining a passage, an annular projection projecting into the passage from the inner surface, and an opening exposing the passage to annular pressure; a mandrel extending into the passage, the mandrel having a first end and a second end; a power spring support detachably connected to the second end of the mandrel in the passage; a power spring arranged about the mandrel and extending between the power spring support and the annular projection; a trigger housing is arranged in one of the mandrel and the power spring support, the trigger housing being selectively aligned with the opening in the housing exposing the passage to annular pressure, and a trigger arranged in the trigger housing selectively engaged with the inner surface, the trigger being operable to disengage from the inner surface of the housing, releasing the power spring, and shifting the mandrel along the passage when exposed to a selected annular pressure.

Embodiment 12. The resource exploration and recovery system according to any prior embodiment, further comprising: a tool support including an outer surface portion, an inner surface portion defining a passage portion, a first end portion, and a second end portion, the second end portion extending into the passage and about the mandrel.

Embodiment 13. The resource exploration and recovery system according to any prior embodiment, further comprising: one of a slip and an expandable packer mounted to the outer surface portion.

Embodiment 14. The resource exploration and recovery system according to any prior embodiment, further comprising: a tubular extending through the passage portion, the tubular including a first end section and a second end section connected to the mandrel.

Embodiment 15. The resource exploration and recovery system according to any prior embodiment, wherein the first end section of the tubular is mechanically connected with the first end portion of the tool support.

Embodiment 16. The resource exploration and recovery system according to any prior embodiment, further comprising: a frangible connector mechanically connecting the tubular and the first end portion of the tool support.

Embodiment 17. The resource exploration and recovery system according to any prior embodiment, wherein the trigger comprises a piston arranged in the trigger housing.

Embodiment 18. The resource exploration and recovery system according to any prior embodiment, further comprising: a shear element affixing the piston in the trigger housing.

Embodiment 19. The resource exploration and recovery system according to any prior embodiment, further comprising: a cap provided at the trigger and a passage extending though the cap fluidically connecting the trigger and the wellbore annulus.

Embodiment 20. The resource exploration and recovery system according to any prior embodiment, wherein the trigger housing is formed in the mandrel.

Embodiment 21. A method of activating a downhole tool comprising: introducing a tubular string supporting the downhole tool into a wellbore formed in a formation;

adjusting pressure in an annulus defined about the downhole tool in the wellbore; activating a trigger at the downhole tool with the pressure in the annulus; releasing a spring upon activating the trigger; and applying a force to a mandrel in the tubular string to activate the downhole tool.

Embodiment 22. The method according to any prior embodiment, wherein applying the force to the mandrel includes forcing slips into contact with a wellbore surface to anchor the downhole tool.

Embodiment 23. The method according to any prior embodiment, wherein applying pressure to the mandrel includes expanding a packer into contact with the wellbore surface.

Embodiment 24. The method according to any prior embodiment, wherein introducing the tubular string into the wellbore includes positioning a casing exit system in the wellbore.

Embodiment 25. The method according to any prior embodiment, wherein activating the downhole tool includes setting an anchor positioned downhole of the casing exit system.

Embodiment 26. The method according to any prior embodiment, further comprising: milling a casing exit after setting the anchor.

Embodiment 27. The method according to any prior embodiment, further comprising: drilling into the formation through the casing exit forming a lateral wellbore.

Embodiment 28. The method according to any prior embodiment, further comprising: producing hydrocarbons through the wellbore and the lateral wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of activating a downhole tool comprising:

introducing a tubular string supporting the downhole tool into a wellbore formed in a formation;

adjusting pressure in an annulus defined about the downhole tool in the wellbore;

activating a trigger at the downhole tool with the pressure in the annulus;

disengaging the trigger from one of the mandrel and a power spring support of the downhole tool;

releasing a spring upon activating the trigger;

applying a force to a mandrel in the tubular string to activate the downhole tool; and wherein the downhole tool comprises a housing including an outer surface, an inner surface defining a passage, an annular projection projecting into the passage from the inner surface, and an opening exposing the passage to annular pressure;

the mandrel extending into the passage, the mandrel having a first end and a second end;

the power spring support detachably connected to the second end of the mandrel in the passage;

the spring arranged about the mandrel and extending between the spring support and the annular projection;

a trigger housing arranged in one of the mandrel and the spring support, the trigger housing being selectively aligned with the opening in the housing exposing the passage to annular pressure; and a trigger arranged in the trigger housing selectively engaged with the inner surface, the trigger being operable to disengage from the inner surface of the housing, releasing the spring, and shifting the mandrel along the passage when exposed to a selected annular pressure.

2. The method of claim 1, wherein applying the force to the mandrel includes forcing slips into contact with a wellbore surface to anchor the downhole tool.

3. The method of claim 2, wherein applying pressure to the mandrel includes expanding a packer into contact with the wellbore surface.

4. The method of claim 1, wherein introducing the tubular string into the wellbore includes positioning a casing exit system in the wellbore.

5. The method of claim 4, wherein activating the downhole tool includes setting an anchor positioned downhole of the casing exit system.

6. The method of claim 5, further comprising: milling a casing exit after setting the anchor.

7. The method of claim 6, further comprising: drilling into the formation through the casing exit forming a lateral wellbore.

8. The method of claim 7, further comprising: producing hydrocarbons through the wellbore and the lateral wellbore.

* * * * *